US011202362B1

(12) United States Patent
Rey

(10) Patent No.: US 11,202,362 B1
(45) Date of Patent: Dec. 14, 2021

(54) SUPERCONDUCTING RESONANT FREQUENCY CAVITIES, RELATED COMPONENTS, AND FABRICATION METHODS THEREOF

(71) Applicant: Christopher Mark Rey, Knoxville, TN (US)

(72) Inventor: Christopher Mark Rey, Knoxville, TN (US)

( * ) Notice: Subject to any disclaimer, the term of this patent is extended or adjusted under 35 U.S.C. 154(b) by 0 days.

(21) Appl. No.: 16/268,686

(22) Filed: Feb. 6, 2019

Related U.S. Application Data

(60) Provisional application No. 62/631,067, filed on Feb. 15, 2018.

(51) Int. Cl.
*H05H 7/20* (2006.01)
*H01P 7/06* (2006.01)
*H01P 11/00* (2006.01)

(52) U.S. Cl.
CPC ..... *H05H 7/20* (2013.01); *H01P 7/06* (2013.01); *H01P 11/008* (2013.01)

(58) Field of Classification Search
CPC ..... H05H 7/20; Y10T 29/49014; C23C 8/60; H01P 7/06; H01P 11/00
See application file for complete search history.

(56) References Cited

U.S. PATENT DOCUMENTS 3,784,452 A 1/1974 Martens et al.
3,805,119 A 4/1974 Koch et al.
3,902,975 A 9/1975 Martens
3,976,950 A 8/1976 Aggus et al.
4,202,931 A 5/1980 Newkirk et al.
4,765,055 A 8/1988 Ozaki et al.
4,857,360 A 8/1989 Halbritter et al.
(Continued)

OTHER PUBLICATIONS

CustomPartNet, "Sand Casting", https://www.custompartnet.com/wu/SandCasting (Year: 2008).*
(Continued)

*Primary Examiner* — Dean O Takaoka
*Assistant Examiner* — Alan Wong
(74) *Attorney, Agent, or Firm* — Luedeka Neely Group, P.C.; Rick Barnes

(57) ABSTRACT

This disclosure relates to an apparatus or device commonly referred to as a superconducting resonant cavity or Radio Frequency (SRF) cavity, the related components associated with the SRF Cavity, and various fabrication methods thereof. SRF cavities are used to accelerate charged particles to high energies and high velocities and various fabrication methods of said SRF apparatus. SRF cavities are used in a wide variety of applications ranging from particle accelerators, to light sources for spectroscopy, to linear accelerators for the transmutation of nuclear waste and the advanced production of tritium, to NMR and MRI imaging and spectroscopy, and proton radiation therapy for the treatment of certain types of cancer.

This disclosure further describes a wide variety of means and methods for: a) the fabrication of SRF cavity structures, b) at least one or more film deposition means, and c) at least one or more heat treating means using either the Bronze Route or Internal Tin processes to form the superconducting $Nb_3Sn$ phase on the interior surface of an SRF cavity via a solid state diffusion reaction process.

20 Claims, 9 Drawing Sheets

(56) References Cited

U.S. PATENT DOCUMENTS

| | | | | |
|---|---|---|---|---|
| 5,239,157 | A | 8/1993 | Sakano et al. | |
| 5,306,406 | A | 4/1994 | Palmieri et al. | |
| 5,347,242 | A | 9/1994 | Shimano et al. | |
| 6,097,153 | A | 8/2000 | Brawley et al. | |
| 7,151,347 | B1 | 12/2006 | Myneni et al. | |
| 7,340,937 | B1 | 3/2008 | May | |
| 7,746,192 | B2 * | 6/2010 | McIntyre | H05H 7/18 333/99 S |
| 7,760,054 | B2 | 7/2010 | Lewellen et al. | |
| 8,042,258 | B2 | 10/2011 | Sennyu et al. | |
| 8,324,134 | B2 | 12/2012 | Saito et al. | |
| 8,330,372 | B2 * | 12/2012 | Kang | H01P 9/00 315/5.41 |
| 8,463,342 | B2 | 6/2013 | Norem et al. | |
| 8,470,155 | B2 | 6/2013 | Saito et al. | |
| 8,630,689 | B2 | 1/2014 | Sennyu et al. | |
| 8,731,628 | B1 | 5/2014 | Agassi et al. | |
| 8,765,053 | B2 * | 7/2014 | Buta | C22C 1/00 420/557 |
| 8,872,446 | B2 | 10/2014 | Tsubota et al. | |
| 8,883,690 | B2 | 11/2014 | Sennyu | |
| 9,330,819 | B2 * | 5/2016 | Schlenga | H01L 39/2409 |
| 9,352,416 | B2 * | 5/2016 | Khare | H01L 39/2406 |
| 10,485,088 | B1 * | 11/2019 | Hassan | H05H 7/20 |
| 2012/0094839 | A1 | 4/2012 | Khare et al. | |
| 2018/0027644 | A1 * | 1/2018 | Cooley | H01L 39/2422 505/210 |

OTHER PUBLICATIONS

Hoosier Pattern Inc, "When to use 3D Printed Sand", https://hoosierpattern.com/news/when-to-use-3d-printed-sand (Year: 2017).*

* cited by examiner

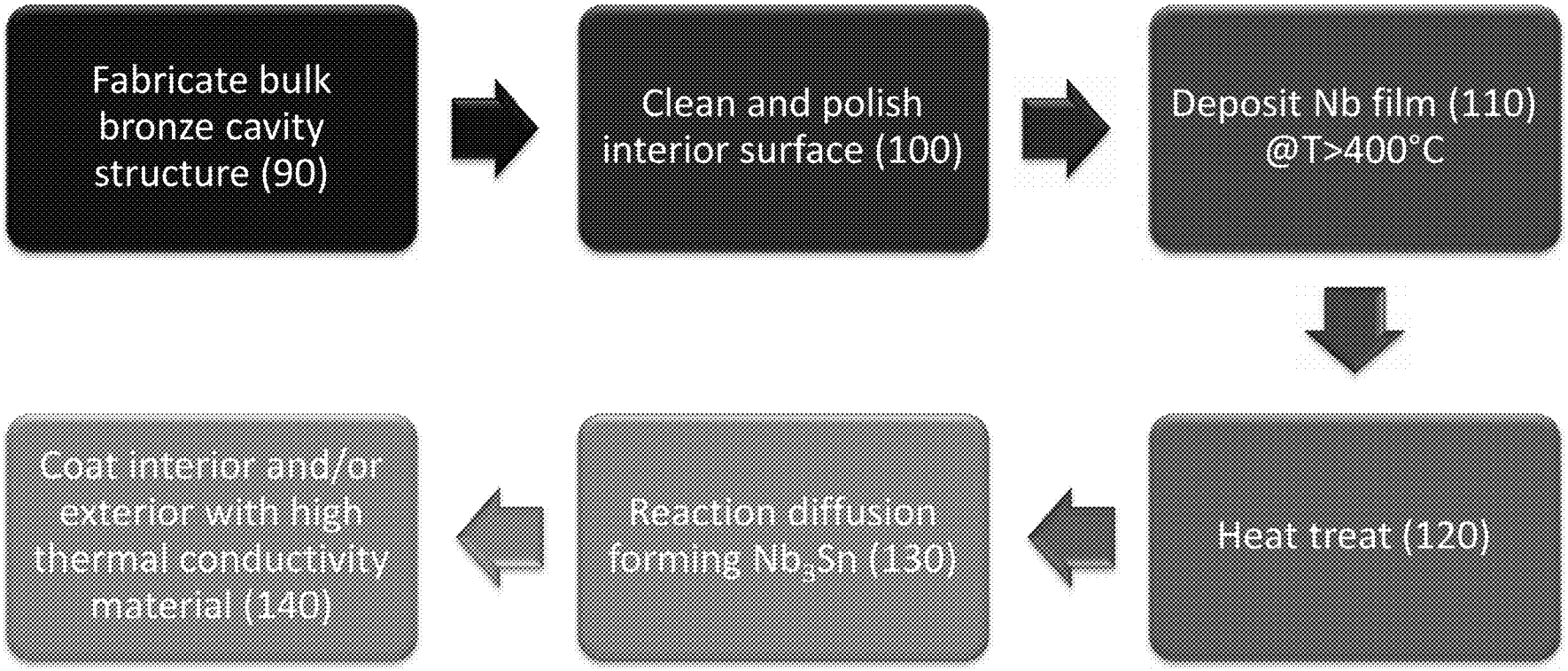
Figure 3: In-situ Bronze Route $Nb_3Sn$ Fabrication Method

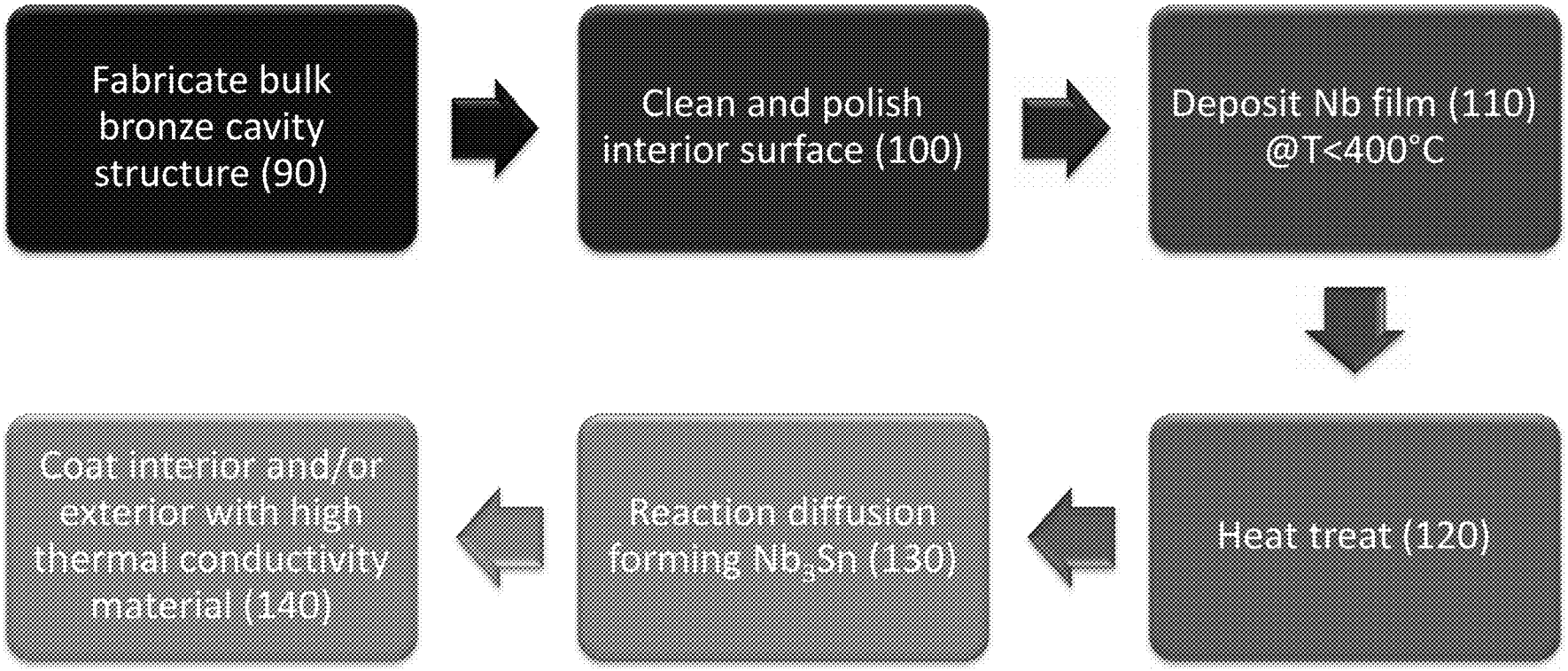
Figure 4: Ex-situ Bronze Route $Nb_3Sn$ Fabrication Method

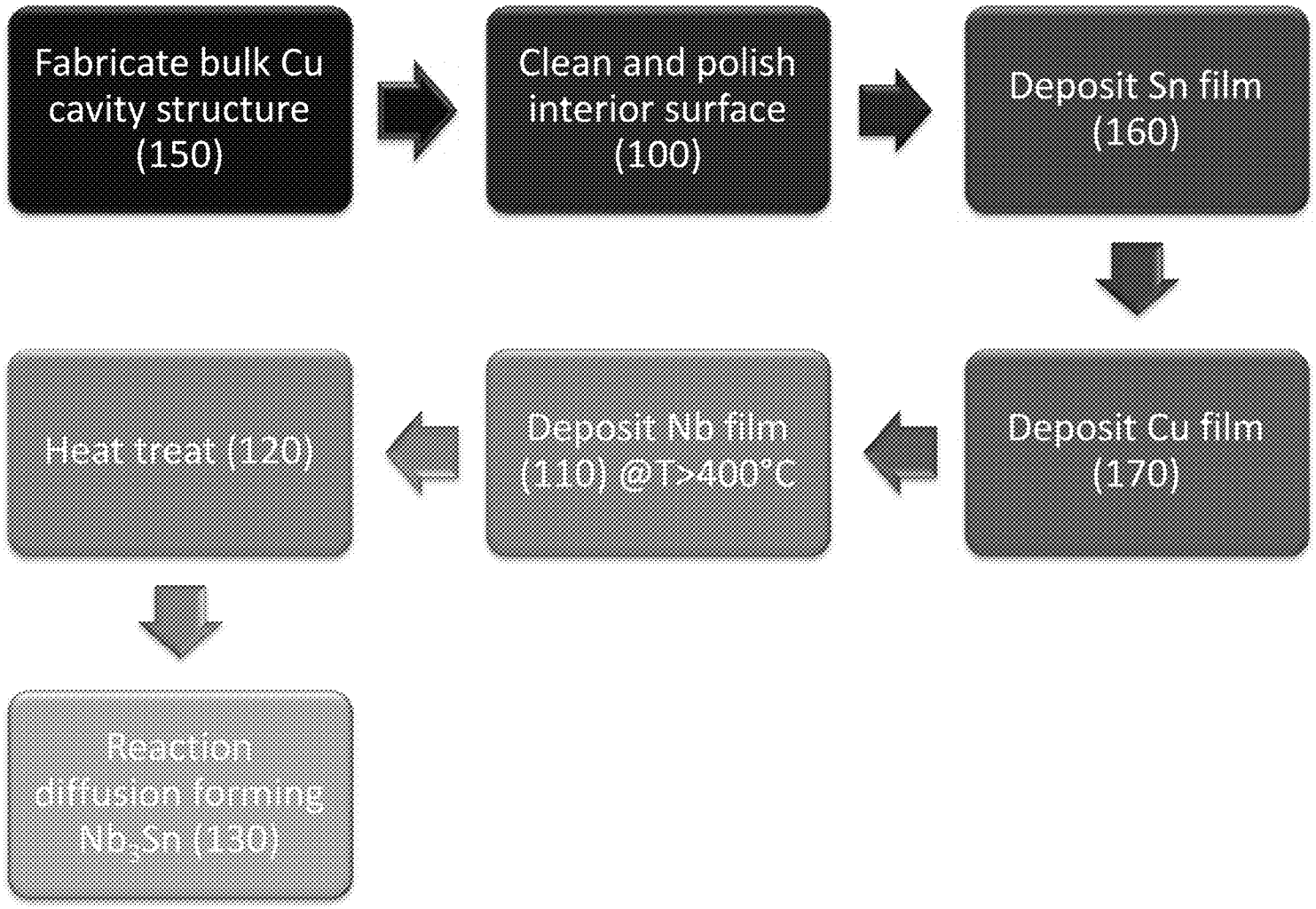
Figure 5: In-situ Internal Tin $Nb_3Sn$ Fabrication Method

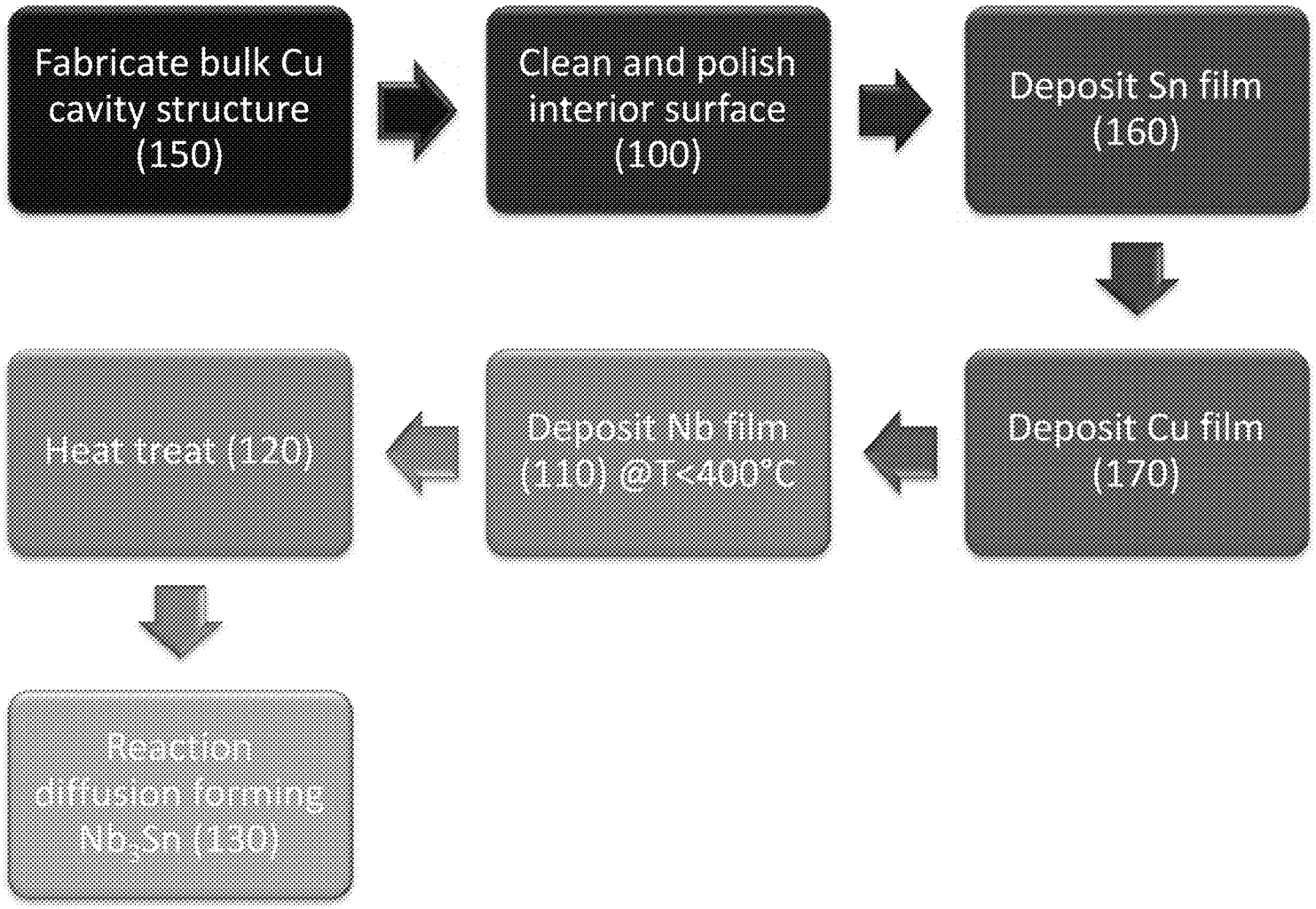
Figure 6: Ex-situ Internal Tin $Nb_3Sn$ Fabrication Method

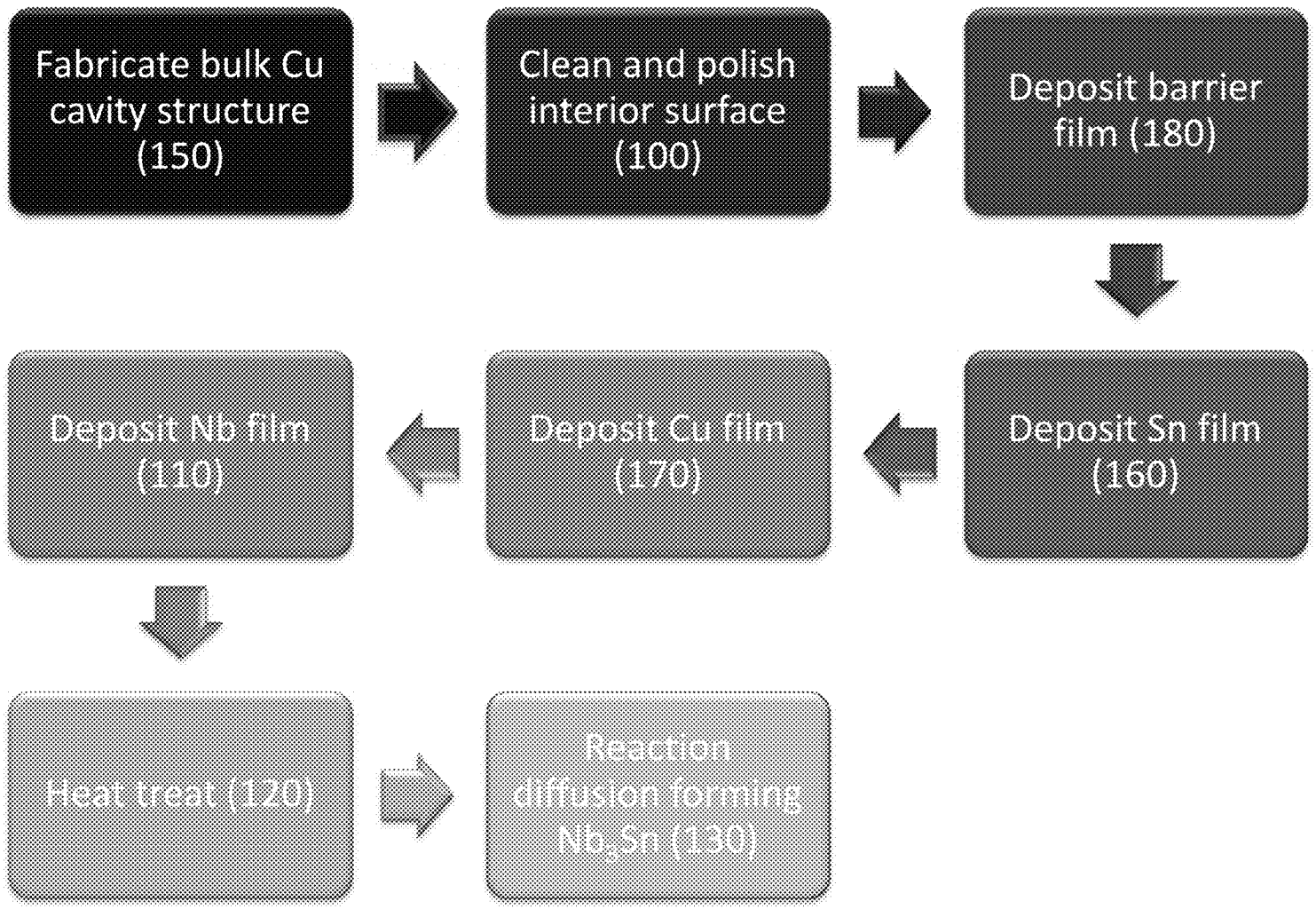
Figure 7: Internal Tin $Nb_3Sn$ Fabrication Method with Barrier Film

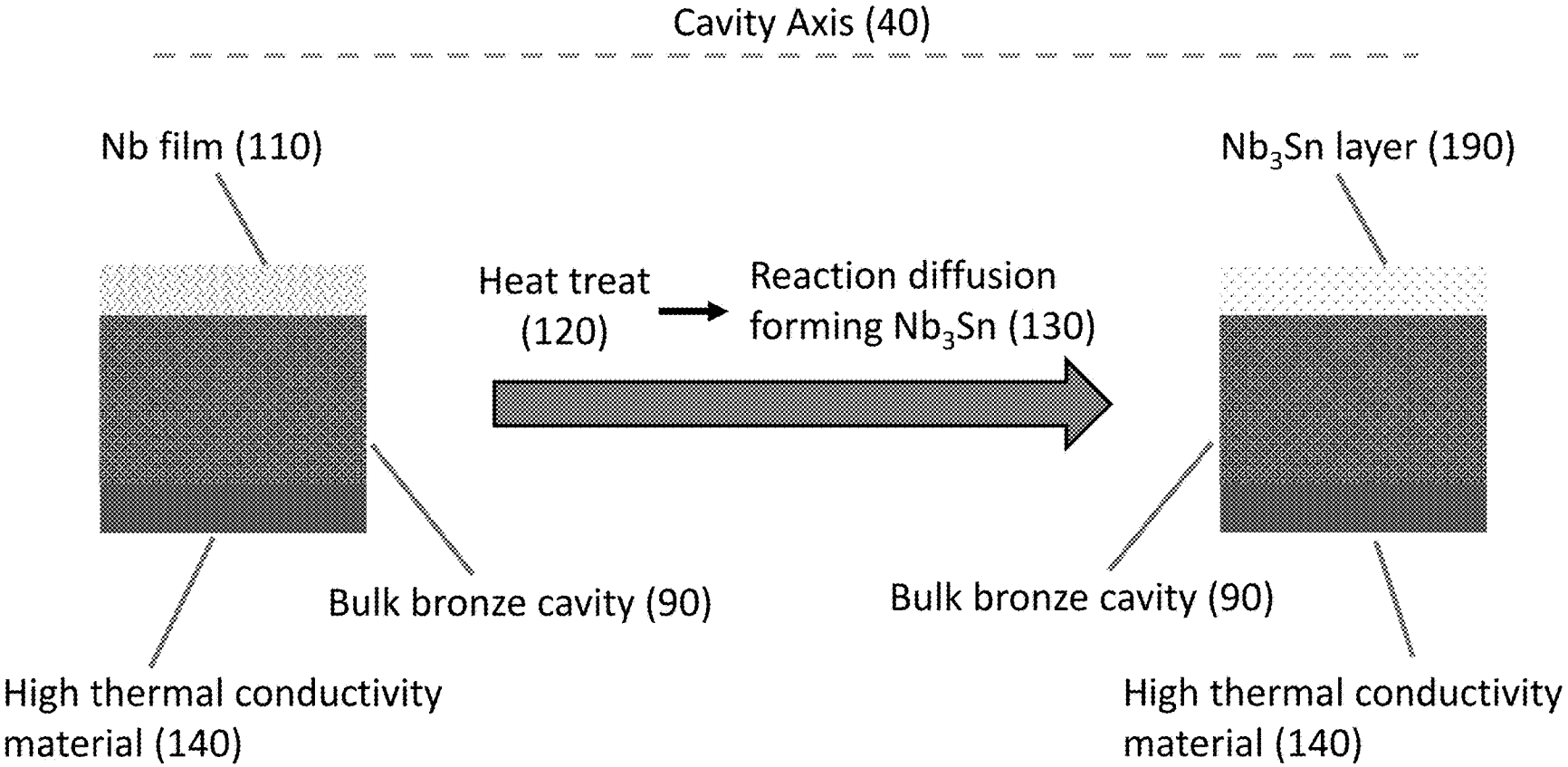
Figure 8: 2D Cross-section of Bronze Route $Nb_3Sn$ Layer

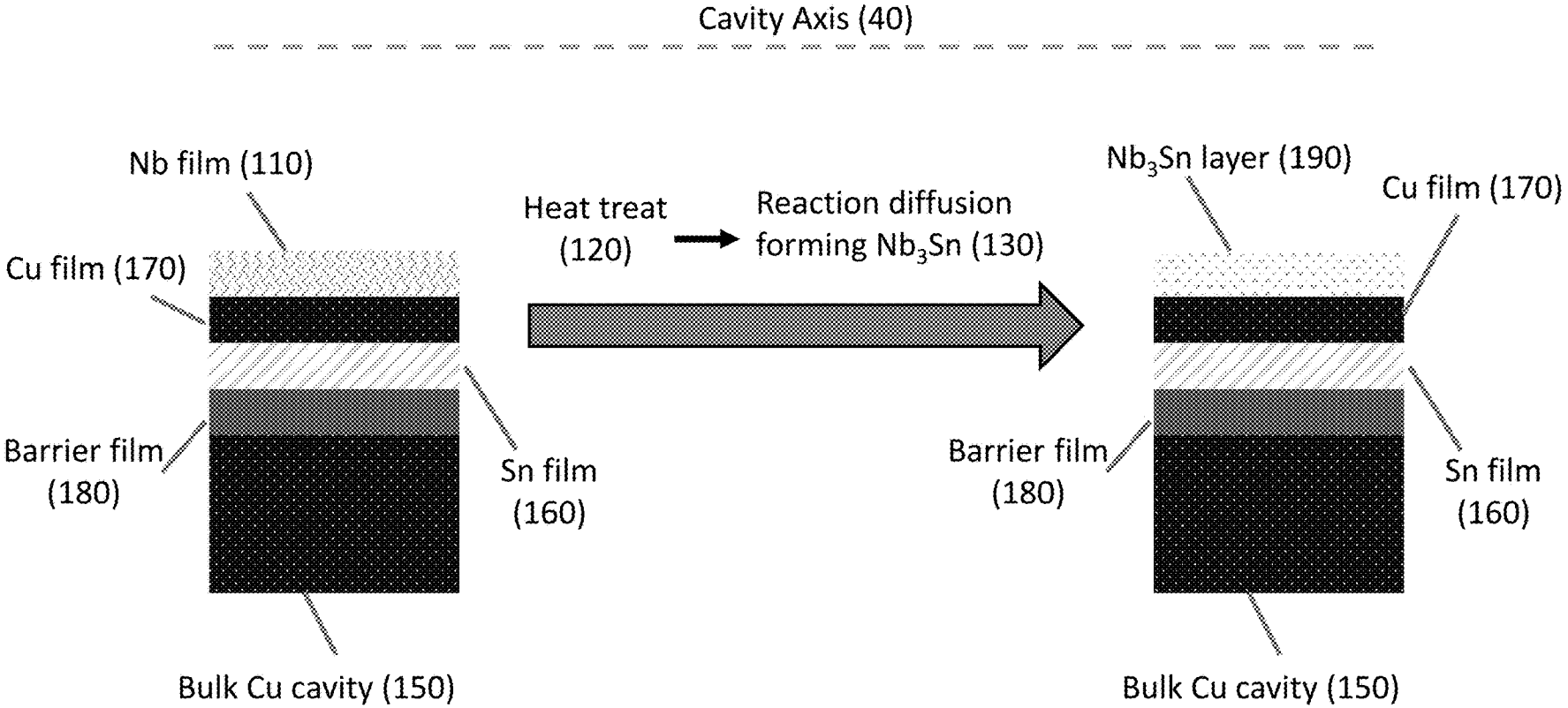
Figure 9: 2D Cross-section of Internal Tin $Nb_3Sn$ Layer

SUPERCONDUCTING RESONANT FREQUENCY CAVITIES, RELATED COMPONENTS, AND FABRICATION METHODS THEREOF

FEDERALLY SPONSORED RESEARCH AND DEVELOPMENT

Not Applicable

PARTIES TO JOINT RESEARCH AGREEMENT

Not Applicable

SEQUENCE LISTING

Not Applicable

PRIOR DISCLOSURES

U.S. provisional Patent Application 62/631,067 filed on Feb. 15, 2018

BACKGROUND OF THE INVENTION

The present disclosure relates generally to an apparatus or device, its related components, and fabrication methods thereof that are designed and configured to accelerate charged particles using an oscillating electric field. The apparatus is sometimes referred to as a superconducting "cavity," "resonator," "resonant cavity," "radio frequency," "accelerator cavity," or more commonly as an "SRF cavity." More particularly, the apparatus and its related components described in this disclosure will render the successful acceleration of chained particles passing therein and can be manufactured by a variety of methods. Superconducting RF cavities (SRF) are used in a wide variety of applications ranging from particle accelerators for nuclear and high energy physics applications, light sources for spectroscopy, to lower energy linear accelerators, known as "linacs" for the advanced production of tritium, the transmutation of nuclear waste, MRI and NMR spectroscopy and imaging, and medical applications such as proton radiation therapy for the treatment of various types of cancers.

DEFINITIONS

The terms, acronyms, and explanations listed in this section are provided for clarity and brevity purposes, and are not to be taken as binding for claim construction.

2D Two dimensional
3D Three dimensional
AC Alternating Current
AM Additive Manufacturing also referred to as 3D Printing
BCP Buffered Chemical Polishing
BCS Bardeen-Cooper-Schrieffer: the quantum mechanical theory based upon an electron-phonon interaction that describes the behavior in many LTS materials
BR Bronze Route Nb3Sn fabrication method
CTE Coefficient of Thermal Expansion
CVD Chemical Vapor Deposition
DMLS Direct metal laser sintering, 3D printing process for metal powders
Egrad Electric field gradient of the cavity, typically expressed in kV/m or MV/m
E-B Electron Beam EBF Electron beam freeform, 3D printing process for metal wire
EBM Electron beam melting, 3D printing process for metal powders
ECR Electron Cyclotron Resonance
EDM Electro Discharge Machining
EP Electro-polishing
G Geometrical shape factor of a cavity typically expressed in ohms
H Magnetic field in the cavity, typically expressed in A/m
He Thermodynamic critical field
Hc1 lower critical field of a type-II superconductor
Hc2 Upper critical field of a type-II superconductor
HIPMS High Power Impulse Magnetron Sputtering
HPP High powered processing
HTS High Temperature Superconductor
IT Internal Tin Nb3Sn fabrication method
Linac Linear accelerator
LTS Low Temperature Superconductor
MRI Magnetic Resonance Imaging
NMR Nuclear Magnetic Resonance
PVD Physical vapor deposition
Q Quality factor of a cavity; a dimensionless quantity
QWR Quarter Wave Resonant cavity
Ra Surface roughness measured in nm
RBCS Frequency, temperature, and magnetic field dependent loss in an SRF cavity, typically expressed in ohms
Rresidual Residual resistance of an SRF cavity, typically expressed in ohms
RF Radio Frequency
Rs Surface resistance of a cavity, typically expressed in ohms
RRR Residual resistance ratio of a material, a dimensionless quantity
SLM Selective laser melting, 3D printing process for metal powders
SLS Selective laser sintering, 3D printing process for metal powders
SRF Superconducting Radio Frequency
Tc Superconducting transition temperature of a superconducting material, typically expressed in K

RELATED ART

Superconducting cavities, also known as SRF cavities, are well known in the art and are used in a variety of fields and areas. The purpose of an SRF cavity and its related hardware is to accelerate charged particles that pass through the cavity to higher energies and hence higher velocities. For example, superconducting RF (SRF) cavities have been described as far back as 1974 for use in charged particle accelerators. A plethora of fabrication methods associated with subtractive engineering processes have been attempted throughout the years to improve the performance and lower the fabrication costs of cavity resonators. For example, fabrication methods of SRF cavities by laser welding techniques. Cavity fabrication by e-beam welding with improved RRR values over prior welding techniques.

RF cavities have been fabricated using beam tube forming with subsequent welding. SRF cavities have been fabricated by Cu and Nb electroforming of composite piping. SRF cavities were fabricated in a multi-step process starting with a disk shape Nb ingot and subsequently slicing the Nb ingot into a plurality of Nb plates and subsequently bonding the plates to for an SRF.

SRF cavities have been fabricated using thin films deposited on non-superconducting core material. A coating of superconducting NbN on complex shaped non-superconducting cavities is described. Nb3Ge is deposited on a Cu substrate using a CVD process. Thin Nb3Sn films are deposited directly on the surface of the bulk cavity/scaffold/structure, including where superconducting films on Nb3Sn or MgB2 are deposited on a split cavity cell and then the split cells are longitudinally welded shut.

Superconducting coated tiles are attached to the inside and outside periphery/equator of a cavity to carry the RF currents.

Superconducting layers of Nb3Sn have been formed on the interior surface of bulk Nb cavities with Sn initially deposited on its interior surface. Heat treatment of these SRF cavities is able to convert the Sn films to the superconducting Nb3Sn phase. The disadvantage of this prior art over the invention described in this disclosure is the use of expensive bulk Nb cavity/scaffold/structure along with its corresponding expending e-beam fabrication process.

Long length superconducting wires operating at direct current have been fabricated using both the Bronze Route and Internal Tin fabrication processes.

As will be seen in the Summary and Detailed Description, the present disclosure achieves its intended purposes, objectives and advantages by accomplishing the needs as identified above, through a new, useful and unobvious combination of component elements and manufacturing practices, techniques, and processes, which are simple to use, with the utilization of a minimum number of functioning parts, at a reasonable cost to manufacture, assemble, and test and by employing only readily available material.

SUMMARY OF THE INVENTION

General Overview

It is an object of the present disclosure to describe an apparatus or device (i.e. an Nb3Sn SRF cavity or Nb3Sn SRF resonator) that is used to accelerate charged particles to higher energies and hence higher velocities. It is also an object of this disclosure to describe various fabrication methods of said SRF apparatus and its related components that overcomes many of the disadvantages of the prior art by combining the superior performance of the Nb3Sn superconducting material over its pure Nb counterpart along a with a low cost bulk cavity/scaffold/structure comprised of either bronze (Cu—Sn) or Cu. Furthermore, it is the object of the present disclosure to describe a low cost fabrication technique for both the bulk bronze and Cu cavity/scaffold/structure such as melt casting or 3D printing. For the purposes of enablement, it is important to distinguish that in the present invention described in this disclosure a pure Nb film either with our without chemical dopants (e.g. Ta, Ti, etc.) is deposited/coated/electroplated on the interior surface of the bulk cavity/scaffold/structure and not a Nb3Sn film. The Nb (or Nb doped) film that is deposited/coated/electroplated on the interior surface of the bulk cavity/scaffold/structure is heat treated upon its in-situ in the deposition chamber or ex-situ via an external furnace to form the Nb3Sn superconducting phase via solid state diffusion reaction process.

There are a plethora of low cost fabrication techniques that could be used to manufacture the bulk cavity/scaffold/structure, which include but are not limited to: melt casting, 3D printing, welding, e-beam welding, brazing, soldering, stamping, punching, tube spinning, forging, among other bulk cavity/scaffold/structure fabrication techniques. For brevity and clarity to aid in the purpose of invention enablement, only the melt casting and 3D printing (i.e. AM) cavity fabrication methods are described in detail in this disclosure, however, this is not meant to limit the scope or type of fabrication methods for the apparatus described in this disclosure and it is understood by one skilled in the art that any one or more of the other SRF cavity/scaffold/structure fabrication methods could be utilized to form the underlying bulk cavity/scaffold/structure and used in combination with the solid state diffusion reaction process described in section 9.2 of this disclosure to form the superconducting phase of Nb3Sn.

Cavity Overview

The SRF apparatus and/or its ancillary hardware and parts/components described in this disclosure comprise a device that will accelerate charged particles to higher energies and hence higher velocities that pass through the device. The device is commonly referred to as a superconducting "cavity," "resonant cavity," "resonator," or "SRF cavity." The descriptive terminology of "resonant SRF cavity" arises because of the devices shape, the electromagnetic resonant mode in which it operates, and the typical frequency range of the oscillating AC electric field, which falls within the so-called "RF" band of the electromagnetic spectrum. The terms cavity, resonant cavity, resonator, and SRF cavity will be used interchangeably throughout this disclosure to have the same meaning. When the RF frequency fed by the antenna is the same as that of a cavity mode, the resonant fields within the cavity build to high amplitudes. Charged particles passing through apertures in the cavity are then accelerated by the electric fields and deflected by the magnetic fields. Resonant cavities typically fall into two basic types: a) standing wave resonators and b) traveling wave resonators. The type chosen will depend upon the application. For example, heavy ions it is generally preferable to use a standing wave resonator. A simple illustration showing the basic operation of a single cell resonant cavity is shown in FIG. 1.

SRF cavities can come in a wide variety of shapes, sizes, and materials depending upon the particular application. Some common factors that help determine the type of cavity are: a) type of accelerator, b) desired particle velocity, c) desired current and duty factor, d) desired accelerating gradient (Eacc), d) desired quality factor (Q), e) desired acceleration and deflecting modes, among other factors.

Cavity Figures of Merit

Some very common figures of merit in resonant cavity design are: a) the frequency of operation (f), which is typically measured in MHz to GHz, b) the accelerating electric field gradient Eacc which is typically measured in kV/m or MV/m, c) the geometrical impedance (G) of the cavity, which is typically measured in ohms, d) the surface resistance (Rs) of the material comprising the cavity, which is typically measured in dims, and e) the quality factory (Q) which is a dimensionless quantity that measures the ratio of the applied energy of the steady state electrical oscillations at the resonant frequency to its energy spread at full width at its ½ maximum or $Q=f/\Delta f$. The sharper or more narrow the spread of energy, the higher the Q of the resonant cavity, among other figures of merit for cavities. The quality factor or Q is an extremely important figure of merit for RF cavities and there are many ways to determine its value. Another way of determining the Q of a cavity is given by the relationship $$Q=\omega U/P_d \quad [2]$$

where ω is the resonant frequency in rads/s, U is the stored energy in J, and Pd is the power dissipated in watts to maintain the stored energy U. The stored energy in the cavity (U) is given by:

$$U=\mu 0/2\int H^2 dv \quad [3]$$

where μ0 is the permeability of free space, H is the magnetic field in the RF cavity in A/m, and dv is the volume integral of the energy density. The power dissipated Pd in the RF cavity is given by:

$$P_d=Rs/2\int|H^2|dS \quad [4]$$

where Rs is the surface resistance of the cavity material measured in ohms (Ω), and dS is the cavity surface over which the energy density is integrated. Thus, the power dissipated in the RF cavity is directly proportional to the surface resistance of the cavity; hence, the lower the surface resistance Rs, the lower the losses in the cavity. The integrals of the electromagnetic field in the above expressions are generally not solved analytically, since the cavity boundaries rarely lie along axes of common coordinate systems. Instead, the calculations are performed by any of a variety of computer programs that solve for the fields for non-simple cavity shapes, and then numerically integrate the above expressions.

Another important figure of merit of a cavity mentioned above in the so-called geometry factor (G). The Geometry Factor measures the cavity's effectiveness of providing an accelerating electric field (Egrad) due to the influence of its shape alone, which excludes specific material wall loss.

The Geometry Factor is given by:

$$G = \frac{\omega\mu_0 \int H^2 dV}{\int H^2 dS} \quad [5]$$

The quality factor of the cavity can then be expressed in terms of its geometrical factor and its materials properties such that:

$$Q = \frac{G}{R_s} \quad [6]$$

The geometry factor (G) is quoted for cavity designs to allow comparison to other designs independent of wall loss, since wall loss for superconducting RF cavities (SRF) can vary substantially depending on material preparation, cryogenic bath temperature, electromagnetic field level, and other highly variable parameters. The geometry factor is also independent of cavity size, it is constant as a cavity shape is scaled to change its frequency. A common method to characterize an RF cavity is to plot its quality factor (Q) vs its accelerating electric field gradient Eacc.

Traditional Cavity Fabrication

To date, both superconducting and non-superconducting cavities have been fabricated using traditional subtractive manufacturing techniques (i.e. machining) with subsequent joining technologies such as welding, brazing, soldering, stamping, punching, tube spinning, among other types of subtractive manufacturing techniques, etc. The most common type of superconducting RF cavity (SRF) is that of pure niobium, although there is a strong technology push towards higher performing superconductors such as the intermetallic A-15 compounds (e.g. Nb3Sn, Nb3Al, Nb3Ge, etc.). A common fabrication technology for such SRF cavities is to form thin walled (1-5 mm) shell components from high purity niobium sheets by stamping. The thickness or thinness of a cavity wall varies depending upon the application, type of material comprising the cavity, and type of cavity itself. Wall thickness typically range from 1-5 mm thick with a common wall thickness of approximately 3 mm, keeping in mind that the cavity with its vacuum on the inside and atmospheric pressure on the outside is a pressure vessel subject to the ASME boiler and pressure vessel regulations and requirements. These bulk Nb shell components are then welded together to form the underlying bulk cavity/scaffold/structure. The distortions caused by these welds can negatively affect the quality and performance of the cavity. As will be discussed in the detailed description section below, a particular advantage for SRF cavity fabrication described in this disclosure using either the melt casting or AM fabrication methods is the reduction and in some cases elimination of these welds typically encountered in prior art SRF cavity fabrication.

High beta superconducting cavities are commonly manufactured by spinning two half cells, which are then electron-beam (E-B) welded together from the inside. The E-B welding is a complicated and costly operation that places severe limitations on the fabrication of high frequency cavities due to the narrow size of the bore. The spinning technique has also been adapted to form a fully seamless resonator without E-B beam welding. In this way, starting from a disk or a seamless tube, it is possible to build seamless cavities with no intermediate annealing, more rapidly, simply, and with a uniform thickness. Both 1.5 GHz niobium and copper cavities can be manufactured with high reproducibility and significant savings in manufacture costs.

Surface Treatments

To improve a cavity performance it is often necessary to further reduce the surface resistance beyond what is achievable after its "raw" fabrication. Inclusions, surface roughness, scratches, etc. as a result of the fabrication process limit the performance of cavities. The melt casted or 3D printed cavities described in this disclosure will also need to be treated after fabrication in order to improve their performance at RF. To achieve this goal, each RF cavities typically undergo a series of successive surface treatments including but limited to: a) mechanical polishing, b) buffered chemical polishing (BCP), c) electro-polishing (EP), d) temperature annealing, e) high power processing (HPP), f) high pressure water rinses, g) assembly in clean room facilities, combinations thereof, among other types of surface treatments.

Mechanical Polishing

To improve the performance of RF cavities both the inner and outer surface are typically mechanically polished and buffered using an abrasive medium adhered to the work wheel. The type of abrasive medium can vary depending upon the type of base material to be polished but some common abrasive materials include but are not limited to $Al_2O_3$, SiC, among other type of abrasive mediums. Common types of polishing or buffering wheels include but are not limited to wood, leather, cotton cloth, plastic, canvas, among other types of polishing wheels.

Chemical Etching BCP and EP

Due to the pillbox-like shape of the cavity, chemical or electrochemical etching is often an efficient technique for improving the surface finish of SRF Nb cavities. Etching to a depth of 100 to 400 μm is believed to be enough to remove the mechanically damaged layer in many Nb SRF cavity fabrication processes. Two widely practiced etching techniques are buffered chemical polishing (BCP) and electro-polishing (EP). A BCP process is usually performed in a typical solution of 1:1:1 or 1:1:2 (volume ratio) HNO3 (69%), HF (49%), and H3PO4 (85%). The process is performed for a time sufficient to remove the layer containing mechanical damage and contaminations. BCP commonly results in Nb dissolution at a rate of 10 μm/min and a final surface roughness of 2 to 5 micron.

High Power Processing

High Pressure Water Rinse

In one embodiment, the RF cavity inner surface is mechanically polished after fabrication to improve its performance. In another embodiment the inner surface of the RF cavity is chemically etched using a process referred to as buffered chemical polishing to improve its performance. In another embodiment the RF cavity inner surface is electropolished to improve its performance.

In another embodiment, the RF cavity is higher power processed to improve its performance. In another embodiment, the RF cavity is cleaned through a high pressure water rinsing process. In yet another embodiment, the RF cavity is subjected to a combination of surface treatments to improve its RF performance and properties.

SRF Cavity Limiting Factors

There are many different phenomena that limit the ultimate performance of SRF cavities including but not limited to: a) multi-pacting, b) thermal quench, c) Q-disease, and d) Field emission, among other limiting factors.

Thermal Breakdown or Quench

Thermal breakdown occurs when the temperature at the surface of the cavity exceeds the critical surface of the superconductor and the SRF cavity quenches. This is primarily caused by a localized heating effect which overcomes the superconducting materials ability to conduct the heat away. The electric field at which breakdown occurs is a heat balance problem that depends upon the magnitude of the heat generation caused by the localized defect balanced against the bulk thermal conductivity of the superconducting material and its convective heat transfer to the surrounding cooling fluid. The primary method for mitigating thermal breakdown in SRF cavities has been through improving the bulk thermal conduction by using highly pure, high RRR Nb. A particular advantage of the normal conducting cavity coated with the superconducting coating is the much higher thermal conductivity of the normal conducting material. For example, the bulk bronze cavity/scaffold/structure used to fabricate Nb3Sn SRF cavity via the Bronze Route, it may be necessary to include a higher thermal conductivity coating or material on the internal or external surface of the SRF cavity (see section 10).

Pressure Vessel

SRF cavities are typically pressure vessels operating with low pressure vacuum on the inside and atmospheric pressure on the outside. Therefore, cavities are typically subject to the mechanical and safety design limitations of pressure vessels, which depending upon its size are often dictated by the ASME Boiler and Pressure Vessel Code. As such, mechanical strength of the bulk underlying cavity/scaffold/structure is an important property. For SRF cavities, mechanical strength at cryogenic temperatures also plays a crucial role it is operational success. A particular advantage of some of the embodiments of this this disclosure in regards to SRF cavity fabrication is the use of high Cu content, alpha phase bronze material for the bulk underlying cavity/cavity/scaffold/structure/structure. Alpha phase bronze has a tensile strength higher than pure Nb at both room and cryogenic temperatures, facilitating the safety and pressure vessel requirements for SRF cavity fabrication and operation.

Cavity Cooling Methods

As mentioned previously, a disadvantage of a SRF over a normal conducting cavity is its low temperature operational requirement and the additional energy expenditure that it takes to reach these low temperatures. An SRF Nb cavity for example, typically operates at <2 K when in operation. To estimate the additional energy required to operate a SRF cavity at 2K, the ideal Carnot efficiency of a refrigerator is given by $$\eta = T_{hot} - T_{cold} / T_{cold} \quad [9],$$

where, Thot is the temperature at which the heat is being rejected by the refrigerator and Tcold is the temperature at which the heat is removed (i.e. the operating temperature of the cavity). Thus, for a 2 K operation and rejection heat at room temperature of approximately 300 K, the Carnot efficiency is 300-2/2=149 or stated otherwise it requires 149 W of room temperature power to produce 1 W of cooling at 2 K assuming an ideal Carnot refrigerator. Assuming a real refrigerator efficiency of 10% of Carnot, this results in ~1500 W of room temperature electrical power to produce 1 W of cooling power at 2 K. Thus, fabricating an RF cavity out of material with a higher superconducting transition temperature or similarly fabricating a non-superconducting cavity and subsequently coating it with a superconducting material with a higher transition temperature Tc could have tremendous benefits.

There are many methods in which to cool superconducting RF cavities some common methods are: a) bath cooling in a two phase liquid, b) cooling in a single phase supercritical fluid, c) bath cooling in a vacuum pumped subatmospheric liquid such as superfluid helium, d) conduction cooling via cryocooler, d) forced convective heat transfer, among other types of cryogenic cooling. The SRF cavity described in this disclosure can be cooled by anyone or a combination of these cooling methods. In one embodiment, the SRF cavity is cooled with a two-phase liquid cryogen such as liquid helium. The temperature of the fluid may be further lowered (e g. <2.2 K) from its boiling point at atmospheric pressure (~4.2 K) by reducing the vapor pressure also referred to as evacuating or pumping on the fluid. Other cryogenic liquids are possible including: hydrogen, neon, nitrogen, air, argon, oxygen, mixtures, thereof, among other cryogenic liquids. In another embodiment, the SRF is cooled by conduction with a cryogenic refrigerator also known as a cryocooler. There are many types of cryocoolers, including: Gifford-McMahon, Stirling, reverse Brayton, turbo-Brayton, pulse-tube, among other types of cryocoolers. In yet another embodiment, the SRF is cooled with a solid cryogen. In still another embodiment, the SRF is convectively cooled by force flowing a cryogenic fluid around or through the cavity itself. In this disclosure, the term cryogenic "fluid" can apply to many aspects of a materials phase diagram including single phase liquids, single phase gas, two-phase gas-liquid mixtures, single phase supercritical fluids, etc.

Cavity Types

There are many types, shapes and sizes for SRF resonant cavities for which the invention described in this disclosure may be used depending upon the application and function of the cavity. Some common types of resonant cavities are the: split loop resonator, spoke cavity, multi-spoke cavity, drift tube linacs, half-wave resonators, quarter wave resonator, elliptical cavity, SRF quadrupole cavity, among other types of resonant cavities.

DRAWINGS

Further advantages of the invention are apparent by reference to the detailed description when considered in conjunction with the figures, which are not to scale so as to more clearly show the details, wherein like reference numbers indicate like elements throughout the several views, and wherein:

FIG. 3 depicts an in-situ bronze route $Nb_3Sn$ fabrication method, according to an embodiment of the present disclosure.

FIG. 4 depicts an ex-situ bronze route $Nb_3Sn$ fabrication method, according to an embodiment of the present disclosure.

FIG. 5 depicts an in-situ internal tin $Nb_3Sn$ fabrication method, according to an embodiment of the present disclosure.

FIG. 6 depicts an ex-situ internal tin $Nb_3Sn$ fabrication method, according to an embodiment of the present disclosure.

FIG. 7 depicts an internal tin $Nb_3Sn$ fabrication method with barrier film, according to an embodiment of the present disclosure.

FIG. 8 depicts a two-dimensional cross-section of bronze route $Nb_3Sn$ layer, according to an embodiment of the present disclosure.

FIG. 9 depicts a two-dimensional cross-section of internal tin $Nb_3Sn$ layer, according to an embodiment of the present disclosure.

DETAILED DESCRIPTION OF INVENTION

SRF Cavity Overview

Figure 1:
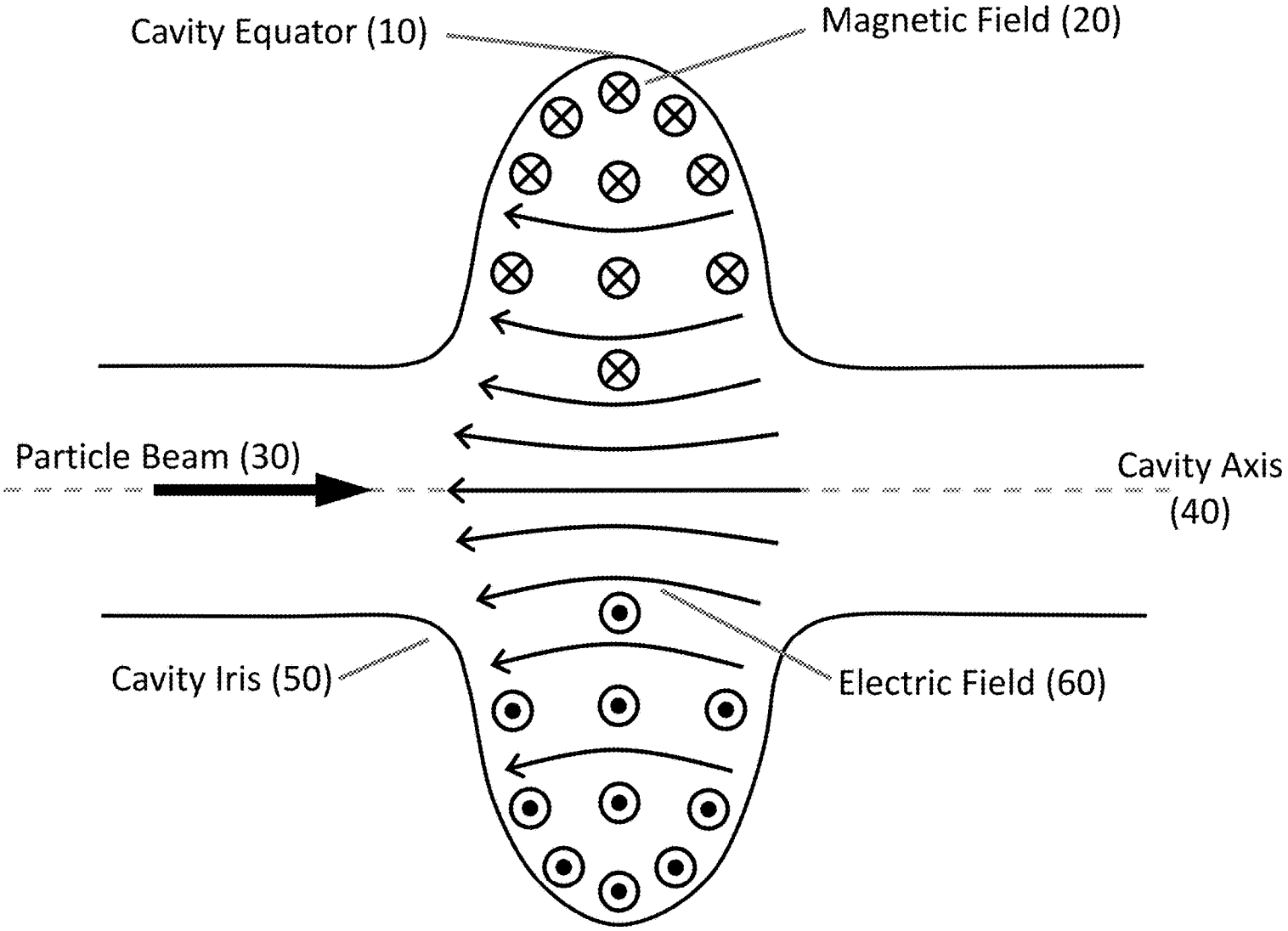
FIG. 1 depicts the operation of a single cell resonant cavity, according to an embodiment of the present disclosure.
Figure 2:
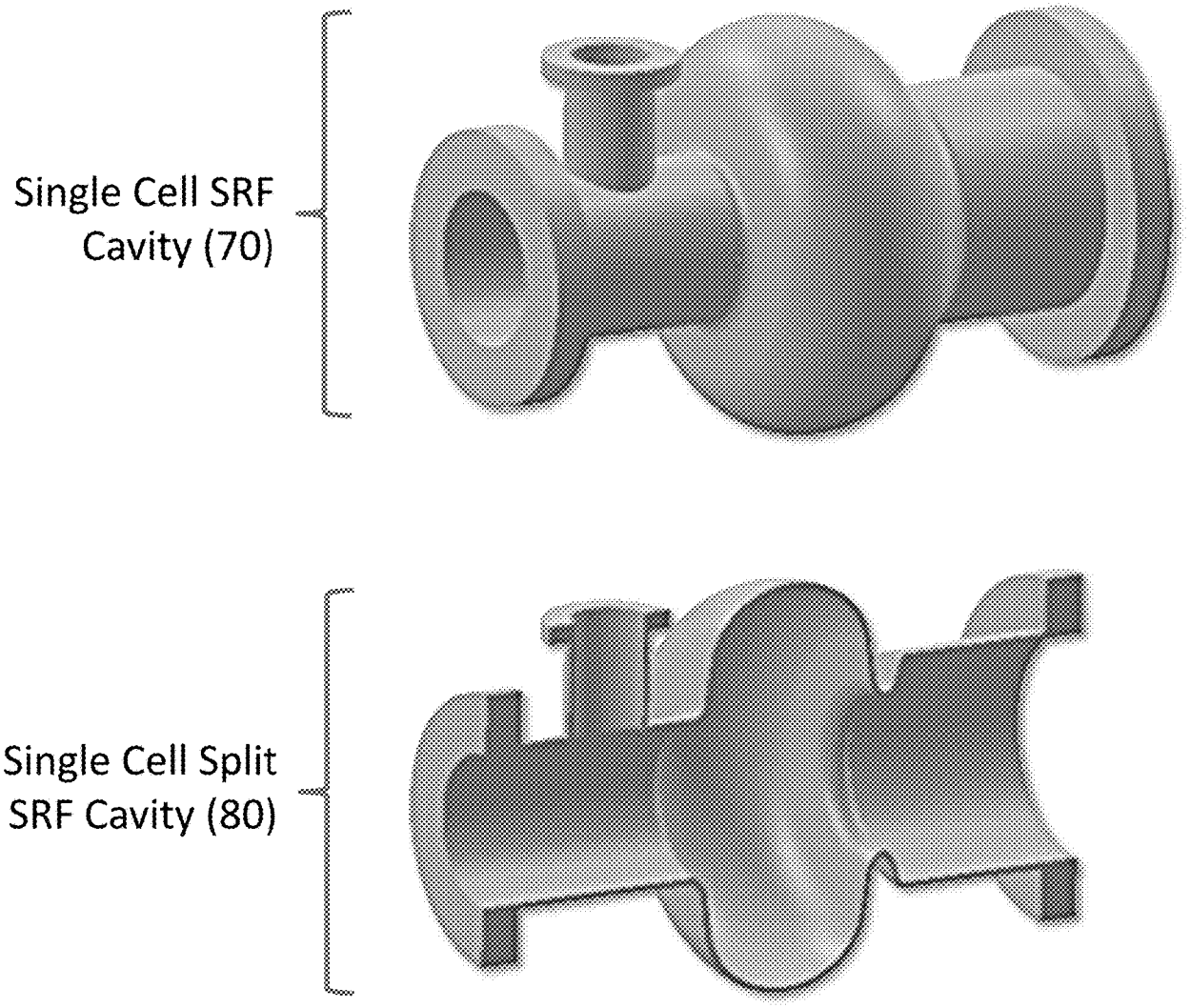
FIG. 2 depicts three-dimensional CAD drawing views of a single cell SRF cavity, depicting both interior and exterior views, according to an embodiment of the present disclosure.

A simple schematic of a typical single cell SRF cavity is shown in FIG. 1. Some common features of an SRF cavity include: cavity equator (10), the magnetic field (20) created by the SRF cavity when in operation, the charged particle beam that traverse along the SRF cavity axis (40), the cavity iris (50) which helps to define the shape or curvature of elliptically shaped cavities and the resulting electric field (60) that is used to accelerate the various types of charge particles. Shown in the upper half of FIG. 2 is 3D CAD drawing of a single cell SRF cavity (70). Shown in the lower half of FIG. 2 is a 3D CAD drawing of a single cell split SRF cavity (80). For a split cavity structure (80), after film deposition on its interior surface, the two halves are joined together to form a single cell SRF cavity structure (70).

Embodiments of the Invention

There are four (4) basic embodiments of this invention that will be described in the detailed description section of this disclosure: 1) A Nb3Sn SRF cavity fabricated via the Bronze Route (BR) using the so-called "in-situ" Nb film deposition process as shown in FIG. 3, 2) a Nb3Sn SRF cavity fabricated via the Bronze Route (BR) using the so-called "ex-situ" Nb film deposition process as shown in FIG. 4, 3) a Nb3Sn SRF cavity fabricated via the Internal-Tin (IT) method using the so-called "in-situ" multi-layer film deposition process as shown in FIG. 5, and finally 4) a Nb3Sn SRF cavity fabricated via the Internal-Tin (IT) method using the so-called "ex-situ" multi-layer film deposition process as shown in FIG. 6. All other embodiments of this invention described in this disclosure are of derivatives of these four basic SRF cavity devices.

Nb3Sn SRF Fabrication Process Steps

Bronze Route Nb3Sn SRF Fabrication Process

Since it is impossible to describe in detail every possible combination and permutation for the Nb3Sn SRF cavity device fabricated via the Bronze Route, the basic fabrication method is comprised of the following high level steps which are shown in FIG. 3 for the in-situ BR method and FIG. 4 for the ex-situ BR fabrication method.

Bulk bronze cavity/scaffold/structure fabricated (90) via low cost process such as AM, melt casting, tube spinning, stamping, punching, forging, etc.

Interior surface preparation, cleaning, and polishing using one or more surface treatments and processes (100).

Deposition of a pure Nb or chemically doped Nb film/coating/layer (approximately 0.05 μm□10 μm thick) on interior surface (110) using one or more film deposition techniques at temperatures ranging from room temperature □~400° C. for the "ex-situ" process (FIG. 4) or >about 400° C. up to 1000° C. for the "in-situ" process (FIG. 5).

For the ex-situ process, after Nb film deposition at <400° C. an optimized heat treatment (120) at temperature, time, and environment (e g. vacuum, inert gas, reducing gas, etc.) for the solid state diffusion reaction (130) to form the stoichiometric (or near stoichiometric) superconducting Nb3Sn phase Partially or fully Coat or cover the interior and/or exterior cavity surface (140) with high thermal conductivity material (e.g. Cu, Ag, Au, etc.). This step may be performed prior to the Nb film deposition as well.

Internal-Tin Nb3Sn SRF Fabrication Process

For the Nb3Sn SRF cavity device fabricated via the Internal-Tin fabrication method, a more complex process involving multiple film coatings (i.e. multi-layers) on deposited on the interior surface of the bulk Cu cavity is required. The sequence and thickness of each successive film layer requires optimization depending upon the type of film deposition processing and heat treatment parameters. Since it is impossible to describe in detail every possible combination and permutation for the Nb3Sn SRF device fabrication using the IT method, some basic high level steps are shown in Figure S for the in-situ IT process and FIG. 6 for the ex-situ IT process:

Bulk Cu cavity/cavity/scaffold/structure/structure fabricated (150) via low cost process such as AM, melt casting, tube spinning, stamping, punching, forging, etc.

Interior surface preparation, cleaning, and polishing using one or more surface treatments (100) of bulk Cu cavity structure (150)

Deposition of thin chemical barrier film or coating (e.g. Ta, Nb, V, etc.) on the interior surface (180) of the bulk Cu cavity structure (150) using one or more film deposition techniques.

Deposition of Sn film/coating/layer (160) on interior surface of the bulk Cu cavity (150) (or on top of the (e.g. Ta) barrier layer (180) described above using one or more film deposition techniques.

The thickness of the Sn layer (160) will depend upon many factors including whether a chemical barrier layer (180) was included in the multi-layer film/coating/layer structure.

Deposition of an additional Cu film/coating/layer (170) (about 0.1->20 μm thick) cm top of the underlying Sn layer using one or more film deposition techniques Deposition of Nb film/coating/layer (110) (0.05 μm→10 μm thick) on the top outermost surface of the thin underlying Cu film/coating/layer (170) using one or more film deposition techniques Optimized heat treatment (120) at temperature, time, environment (vacuum, inert gas, reducing environment, etc.)

for the solid state diffusion reaction (130) to form the stoichiometric (or near stoichiometric) superconducting Nb3Sn phase Bulk Cavity, Cavity/Scaffold/Structure 3D Printing or Additive Manufacturing Next, we describe the fabrication process of the basic underling physical structure of the Nb3Sn SRF cavity itself. The bulk cavity/scaffold/structure (90) or (150) is the pressure vessel that supports the atmospheric pressure on the outside of the Nb3Sn SRF cavity from its vacuum environment of its interior. Two of the four Nb3Sn SRF cavity embodiments use bronze (90) as the cavity/scaffold/structure material (i.e. Bronze Route), while the remaining two Nb3Sn SRF embodiments that use the IT fabrication process use pure Cu or nearly pure Cu as its bulk cavity/scaffold/structure (150). Please note that the terms bulk cavity, scaffold, and structure are used interchangeably throughout this disclosure for the purposes of clarity and enablement.

As stated previously, whether fabricated from bronze or Cu, there are a plethora of methods that one could implement to fabricate the bulk cavity/scaffold/structure (90) or (150); however, two fabrication methods are described in more detail for the purposes of clarity and enablement: a) 3D Printing (aka AM) and b) Melt Casting, but are not meant to limit the type of fabrication method or methods for the Nb3Sn SRF invention described in this disclosure. The first low cost SRF cavity/scaffold/structure (90) or (150) fabrication method described in this disclosure use the direct printing of metallic particles. Some common types of 3D printers for the direct printing of metals are the wire and granular/powder type include but are not limited to: direct metal laser sintering (DMLS), electron beam melting (EBM), electron beam freeform (EBF), selective laser melting (SLM), and selective laser sintering (SLS), among other types of metal 3D printers.

Another 3D printing technique that is particular advantageous to some of the embodiments described in this disclosure is a technique known as indirect 3D printing, or more commonly referred to as Indirect 3DP. Indirect 3DP is a unique indirect 3D printing process developed by the ExOne Corporation of St. Clairsville, Ohio that is based upon "ink-spray or ink-jet" technology. Indirect-3DP works by utilizing inkjet deposition of "binders" into a powder bed in the forming process. By using Inkjet in the forming process, the layers of the part can be created rapidly and at high resolution. Furthermore, by fusing the powders using a separate well-regulated heating oven, thermal gradients created within the part can be avoided. In this indirect 3D printing method, the material of interest is loaded into the printer in a powder form, combined with a binding material, and 3D printed using an ink-spray technique. The binding material initially "glues" the powders together and the 3D printed piece is then moved to a separate curing oven. The 3D printed piece is then separately cured at a low temperature (~150-200° C.) to burn off the "binding" material. There are many types of powders that can be printed using the Indirect 3DP process including but not limited to: metals, insulators, plastics, polymers, ceramics, glasses, wood, and sand, among other types of powders. It is particularly advantageous for some of the embodiments described in this disclosure to use either "sand or ceramic" powders to 3D print molds used for bronze or Cu melt casting of the bulk cavity/scaffold/structure (90) or (150) or "metal" powers for the 3D printing of normal or superconducting cavities and their related components. The porosity of the 3D printed object after binder burn off typically varies between about 20 to 40% (i.e. 60-80% part density), although other porosities of the Indirect 3DP printed object are possible. If the 3D printed object is a metal and further densification of the 3D printed metal object is desired (e.g. to improve mechanical strength, enhance thermal conductivity, improve SRF properties, etc), then the 3D printed object can be either: a) sintered a second time at a higher temperature closer to the melting temperature of the metal powder or b) "infiltrated" with another liquid molten metal using an "infiltration" process.

The porosity of the Indirect 3DP printed bronze cavity or cavity component can be reduced, i.e. the SRF apparatus density increased, by sintering the Indirect 3DP cavity or cavity component in a separate curing oven at a temperature close to the melting temperature of the bronze powder.

This will cause the dimensions of the cavity or cavity component to shrink. The amount of dimensional change in the sintered cavity is directly related to its initial starting porosity prior to sintering. The resultant dimensional change in the SRF cavity or cavity component should be considered in the design of the apparatus described in this disclosure.

A second method used to increase the apparatus density (i.e. reduce porosity) is to use a molten metal infiltrate to fill the pores of the Indirect 3D printed structure. Serenedipously, a common molten metal "infiltrate" used in the Indirect 3DP process is bronze (Cu:Sn), which is particularly advantageous to the two embodiments that use bronze as its underlying cavity/scaffold/structure (90).

Melt Casting of the Invention

Another low cost fabrication method for the bulk cavity/scaffold/structure is that of melt casting. Metal casting is one of the oldest and most commonly used metallurgical fabrication processes for a wide variety of devices. For the purposes of enablement in this disclosure, bronze (90) and copper (150) casting is particularly advantageous for the four embodiments described herein for the Nb3Sn SRF device Both bronze and Cu melt casting for example is a low cost, well understood, metallurgical fabrication techniques which dates back millennia. Using the melt casting technique applied to the apparatus described in this disclosure, bronze with a Cu content typically ranging from 75% to 92% and its corresponding Sn content proportionally ranging from 25% to 8% is casted into the desired shape of the cavity (e.g. 5-cell or 9-cell elliptical cavity, crab cavity, spoke cavity, etc.) or a cavity related component (e.g. RF coupler). Other Cu/Sn ratios are also possible including pure or nearly pure Cu of example in the internal-tin solid state diffusion reaction process.

Split Cavity Fabrication

ASRF cavity is fabricated by depositing/coating a film on the interior surface of a split cavity (80) scaffold/structure and then after film deposition joining the two halves of the cavity together. Once the two halves are joined (70), the SRF cavity can be heat treated to form the correct superconducting phase or simply further enhance its RF properties. The advantages of the split SRF cavity fabrication technique is that depending upon the film deposition technique, it may be easier to coat the interior surface of the scaffold when in its split geometry rather than its closed cavity configuration.

This is not the case for all thin film deposition means such as electroplating, where it is advantageous to fabricate the cavity scaffold/structure as a whole unit, thereby avoiding the subsequent joining of the two halves. When using an electroplating film deposing means, the cleaned and polished interior surface of the cavity scaffold/structure can be electroplated with one or more films and subsequently heat treated via the ex-situ process to form the correct Nb3Sn superconducting phase.

Interior Surface Preparation

Regardless of the fabrication method or material bronze (90) or Cu (150) selected for the bulk cavity/scaffold/structure, the interior surface for all four embodiments of this invention will need some type cleaning and polishing (100) prior to film/coating/layer deposition. The amount and type of surface preparation for the interior surface of the bulk cavity/scaffold/structure will depend on the type of bulk cavity/scaffold/structure fabrication method. The interior surface of the bulk cavity/scaffold/structure and/or cavity component is typically polished (100) using one or more of the surface treatments described in section 8.5 or similar. For some of the embodiments described in this disclosure it is important that the surface roughness (Ra) of the interior wall of the cavity/scaffold/structure is <1-5 nm for optimal Nb film deposition.

Solid State Diffusion Reaction Process

For each of the four Nb3Sn SRF cavity embodiments described in this disclosure, namely a) in-situ BR, b) ex-situ BR, c) in-situ IT, and d) ex-situ IT, four different diffusion reaction processes (130) are utilized to form the stoichiometric or near stoichiometric Nb3Sn superconducting phase with each requiring its own unique optimized heat treatment cycle (120). For the purposes of brevity, clarity, and enablement, an optimized heat treatment cycle is defined as the furnace ramp rate (in ° C./hr), furnace soak temperature (in ° C.) and time, and furnace environment (e.g. vacuum, inert gas species, etc.) to achieve an optimized performance of the SRF device. For the purposes brevity and invention enablement, a high level overview of these diffusion reaction processes are described below; however, it is recognized by one skilled in the art that there may exist a plethora of heat treatment cycles each requiring multiple soak temperatures and multiple dwell times in order to optimize performance.

In-situ Nb3Sn Bronze Route (BR) Fabrication

In one embodiment, the Nb3Sn SRF device is fabricated using the in-situ Bronze Route fabrication method as shown in FIG. 3. For this embodiment, the polished and cleaned interior surface temperature of the bulk bronze cavity (90) is held above about 400° C. during Nb film/coating/layer deposition. A thin Nb film/coating/layer (110) is deposited on the interior surface of the bulk cavity/scaffold/structure or cavity related component at surface temperature ranging anywhere from about 400° C. to 1000° C. Lower temperatures tend to form smaller grains sizes whereas higher temperatures tend to form larger grains sizes. Larger grain sizes may be preferred to improve the RF properties of the SRF cavity. There are many films deposition/coating techniques that can be used to deposit the Nb films including but not limited to: RF/DC sputtering, CVD, MOCVD, laser ablation, ECR, HIPMS, sol-gel, electroplating, among other thin film deposition techniques. When the Nb films are deposited at these high surface temperatures, the superconducting Nb3Sn phase begins to form immediately. Using the in-situ BR process, the resultant Nb3Sn particle size typically varies between ~20-50 nm. The optimal temperature/time of the bulk bronze cavity/scaffold/structure during Nb film deposition/coating for the in-situ Nb3Sn fabrication method can be determined by the RF property desired. A 2D sketch of the cross section of an SRF cavity surface using the BR fabrication process is shown in FIG. 8.

Ex-Situ Nb3Sn Bronze Route (BR) Fabrication

In a second embodiment, the Nb3Sn SRF device is fabricated using the ex-situ Bronze Route fabrication method as shown in FIG. 4. Using the ex-situ BR fabrication technique, the surface temperature of the bronze interior wall is held below about 400° C. all the way down to room temperature. At these lower surface temperatures, the as deposited Nb film (110) does not immediately "react" with the bronze surface of the bulk cavity/scaffold/structure (90). It is common not to deposit the Nb films on the bronze surface at room temperature because of the CTE mismatch between the brittle Nb3Sn superconducting phase and the underlying bronze cavity/scaffold/structure. This CTE mismatch can be mitigated by depositing/coating the interior wall of the cavity at temperatures higher than room temperature, but lower than the reaction temperature used in the "in-situ" process described above. The Nb film coated bronze cavity is then placed in separate heat treatment oven (120). Common heat treatment temperatures can range from as low as ~400° C.-up to 1000° C. Heat treatment times can vary from just a few hours to hundreds of hours depending upon the furnace soak temperature. Lower furnace soak temperatures and longer dwell times tend to form smaller Nb3Sn grain sizes while higher furnace soak temperatures and shorter dwell times tend to form larger Nb3Sn grain sizes. Smaller Nb3Sn grain sizes tend to optimize DC superconducting properties in the Vortex state, which has been beneficial to superconducting wire properties, while larger Nb3Sn grain sizes tend to optimize RF properties in the Meissner state of a superconductor, which is beneficial to SRF cavities.

Sometimes multiple furnace soak temperatures and dwell times are required for optimized properties. For example, it is common in Nb3Sn wire fabrication via the BR method to use a two-step diffusion reaction process. The first step in the heat treatment cycle is typically about a 100-200 hour soak at 575° C. and with a slow ramp at 5° C./hr to a second soak at 650° C.-700° C. for 100 hours.

Using this ex-situ technique, the Sn from the high Cu content bronze then slowly diffuses (130) into the thin Nb film forming the stoichiometric (or near stoichiometric) superconducting Nb3Sn phase through a solid state diffusion reaction process known as the Bronze Route (BR). The time and temperature profile as well as the type of environment (e.g. vacuum, inert gas, reducing, etc.) during the heat treatment cycle for this solid state diffusion reaction process (130) can be adjusted as necessary to maximize the RF performance and properties of the bulk cavity/scaffold/structure or cavity related component. Using the ex-situ fabrication method, the resultant Nb3Sn particle size is somewhat larger than the in-situ method typically ranging between ~50-100 nm. The length scale over which the Sn will diffuse from the underlying bronze cavity/scaffold/structure is typically less than 0.5-5 μm, which is more than adequate for SRF cavities. A 2D sketch of the cross section of an SRF cavity surface using the BR fabrication process is shown in FIG. 8.

In-situ and Ex-Situ Nb3Sn Internal-Tin (IT) Fabrication

In the third and fourth embodiments of the invention described in this disclosure, the Nb3Sn SRF device is fabricated using the either "in-situ" or "ex-situ" Internal-Tin fabrication method as shown in FIGS. 6 and 7, respectively. As stated previously, the IT Nb3Sn fabrication method is far more complex in terms of its multi-layer film deposition processes, more complex phase diagram, and its more involved heat treatment cycle. There are several major differences between the BR and IT Nb3Sn SRF fabrication methods including: a) bulk cavity/scaffold/structure (150), b) multi-layer film deposition process, and c) heat treatment cycle (120). The first major difference between the BR and IT Nb3Sn fabrication methods is the material comprising the bulk cavity/scaffold/structure (150). For the IT Nb3Sn fabrication method, the bulk cavity/scaffold/structure is pure (or nearly pure) Cu (150) and not bronze (Cu—Sn). The Cu cavity/scaffold/structure is advantageous because of its higher thermal conductivity (see also section 8.6), although its mechanical strength is somewhat weaker requiring a thicker wall to compensate for the weaker tensile strength of Cu vs. bronze. Unlike the BR method which involves the deposition/coating of just one type of film (i.e. pure Nb or chemically doped Nb), the IT fabrication method involves the deposition of a series of multiple thin films or coatings on the cleaned and polished (100) interior surface of the bulk Cu cavity/scaffold/structure (150). In these two IT embodiments, multiple films are deposited in series on the interior surface of the surface of the bulk Cu cavity/scaffold/structure (150). The sequence of the deposition/coating/plating of these multiple films is shown in FIGS. 6 and 7. For the IT process, electroplating is a particular simple and straight forward approach to depositing many of the film layers. Each of the multiple films is deposited in succession, with one layer deposited directly on top of the previous layer. There are two different derivatives of these two embodiments: a) a three-layer multiple film structure and b) a four-layer multiple film structure. For clarity and purposes of enablement, the terms layer/film/coating have the same meaning and are used interchangeably thought this disclosure In the three-layer film derivative of these two IT embodiments, the first layer/film/coating deposited on the interior surface of the bulk Cu cavity/scaffold/structure (150) in a relative thick Sn film ranging in thickness from about 1μ to 100 μm (160). The second layer/film/coating is a thin (0.05-40 μm) Cu film deposited (170) directly on top of the Sn layer/film/coating (160). The third and final layer/film/coating in the three-layer/film/coating derivative is Nb (0.05 μm->10 μm) (110). During the heat treatment (120) a solid state diffusion reaction process (130) occurs, the Sn layer/film/coating (160) diffuses in both directions, i.e. into the thick bulk Cu cavity/scaffold/structure (150) and into the thin Cu layer/film/coating (170) on its top surface.

Eventually the Sn (160) will diffuse (130) into the outermost Nb layer/film/coating (110) forming the desired stoichiometric (or near stoichiometric) Nb3Sn superconducting phase (190).

In the four-layer film derivative of these two IT embodiments, the first layer/film/coating deposited/plated cm the interior surface of the bulk Cu cavity/scaffold/structure (150) in a thin chemical barrier layer/film/coating (180) of either Ta, V, Nb, or some other chemical barrier material. The second layer/film/coating is a relatively thick Sn film (160) on top of the Ta (or equivalent) chemical barrier layer/film/coating (180). The third layer/film/coating is a thin (0.05-20 μm) Cu film (170) deposited/plated directly on top of the Sn layer (160). The fourth and final layer/film/coating in the four-layer film derivative is a thin film of Nb (0.1-10 μm) comprising the outermost layer (110). The advantage of the four-layer derivative versus the three-layer of the two IT embodiments, is that the chemical barrier film/coating/layer (180) on the innermost interior surface of the bulk Cu cavity/scaffold/structure (150) prevents/inhibits the Sn in the second layer/film/coating (160) from diffusing (130) into the bulk Cu cavity/scaffold/structure (150) during heat treatment (120). This preferentially allows the Sn layer/film/coating (160) to diffuse (130) through the Cu layer/film/coating (170) during heat treatment (120) on its surface thereby preferentially promoting the formation of the desired stoichiometric (or near stoichiometric) superconducting Nb3Sn phase (190) on the outermost surface of the multi-layer film coating. The disadvantage of the four-layer approach versus the three-layer is the additional chemical barrier layer/film/coating (180) required on the interior surface of the bulk Cu cavity/scaffold/structure (150), adding unwanted cost and complexity to the IT fabrication process. A 2D sketch of the cross section of an SRF cavity surface using the four-layer IT fabrication process is shown in FIG. 8.

Heat Treatment Means

Two embodiments of the invention described in this disclosure use an "in-situ" heat treatment means (120), where the film or multiple series of films are deposited at elevated temperature greater than about 400° C. directly in the film/coating/layer deposition chamber. At these elevated deposition temperatures, the desired stoichiometric (or near stoichiometric) superconducting Nb3Sn phase (190) can form more rapidly reducing the SRF fabrication time and therefore cost. The other two embodiments of the invention described in this disclosure use an "ex-situ" heat treatment means (120), where the film or multiple series of films are deposited at less than about 400° C. This typically use a separate heat treatment furnace.

The heat treatment means for either the in-situ or ex-situ SRF fabrication method includes but is not limited to: conductive heating, convective heating, radiative heating, non-contact inductive heating, and combinations thereof. During the ex-situ heat treatments it is advantageous to be in an inert, oxygen free, or slightly reducing environment. Typically, the ex-situ heat treatments are performed in either a vacuum furnace or an inert Ar atmosphere.

High Thermal Conductivity Coating of Exterior Surface

An important property for any SRF cavity is to have high thermal conductivity. A high thermal conductivity bulk cavity/scaffold/structure is important in order to aid in the dissipation of heat generated by the BCS losses which are developed by the superconducting material at RF frequencies. Unfortunately, for the two embodiments involving the bulk bronze cavity/scaffold/structure, bronze has a somewhat low thermal conductivity ranging from approximately 10-50 W/m-K depending upon the Cu content at the operating temperatures of interest ~2 K→4.2K. This low thermal conductivity may be inadequate to remove the heat generated by the BCS losses (or other heat sources) and may need to be improved for stable operation. In order to improve the conductive heat transport properties of the underlying bulk cavity/cavity/scaffold/structure/structure (90), it may be necessary to coat the exterior wall of the bronze casted cavity with a higher thermal conductivity material such as Cu, Sn, or A (140)1. There are many low costs metal coating technologies that could be used to coat the exterior wall of the bronze casted cavity or cavity component including but not limited to: electro-plating, thermal evaporation, RF/DC sputtering, among other types of metal coating techniques.

While the disclosure has been particularly shown and described with reference to various embodiments described herein, it will be understood by those skilled in the art that various changes in form and detail may be made without departing from the spirit and scope of the disclosure. The foregoing has outlined some of the more pertinent objects of the disclosure. These objects should be construed to be merely illustrative of some of the more prominent features and application of the intended invention. Many other beneficial results can be obtained by applying the disclosed invention in a different manner or modifying the invention within the scope of the disclosure.

Accordingly, a fuller understanding of the invention may be had by referring to the detailed description of the preferred embodiments in addition to the scope of the invention defined by the claims taken in conjunction with the accompanying drawings.

The invention claimed is:

1. A method of forming a niobium-tin superconducting radio frequency device having a cavity, the method comprising the steps of:

forming a unified bulk structure formed of a material including bronze, forming a niobium layer on an interior of the unified bulk structure, and heat treating the unified bulk structure and niobium layer to form a superconducting niobium-tin layer on the interior of the unified bulk structure.

2. The method of claim 1, wherein the unified bulk structure includes a plurality of cavities disposed in a series.

3. The method of claim 1, further comprising cleaning the unified bulk structure prior to forming the niobium layer, using mechanical and chemical polishing.

4. The method of claim 1, wherein the unified bulk structure is formed completely of bronze.

5. The method of claim 1, wherein the superconducting niobium-tin layer is formed with a substantially stoichiometric $Nb_3Sn$ composition.

6. The method of claim 1, wherein the step of forming the unified bulk structure is performed by melt casting.

7. The method of claim 1, wherein the step of forming the unified bulk structure is performed by 3D printing.

8. The method of claim 1, wherein the step of forming the unified bulk structure is performed by melt casting in a 3D printed sand mold.

9. The method of claim 1, wherein the step of forming the niobium layer is performed by sputtering.

10. The method of claim 1, wherein the niobium layer is doped with at least one of titanium, tantalum, or vanadium.

11. A method of forming a niobium-tin superconducting radio frequency device having a cavity, the method comprising the steps of:

forming a unified bulk structure formed of a material including copper, forming a tin layer on an interior of the unified bulk structure, forming a copper layer on the tin layer, cleaning the copper layer using mechanical and chemical polishing, forming a niobium layer on the cleaned copper layer, and heat treating the bulk structure, tin layer, copper layer, and niobium layer to form a superconducting niobium-tin layer on the interior of the unified bulk structure.

12. The method of claim 11, wherein the unified bulk structure is formed completely of copper.

13. The method of claim 11, wherein the superconducting niobium-tin layer is formed with a substantially stoichiometric $Nb_3Sn$ composition.

14. The method of claim 11, wherein the step of forming the unified bulk structure is performed by melt casting.

15. The method of claim 11, wherein the step of forming the unified bulk structure is performed by melt casting in a 3D printed sand mold.

16. The method of claim 11, wherein the step of forming the unified bulk structure is performed by 3D printing.

17. The method of claim 11, wherein the steps of forming the tin layer, the copper layer, and the niobium layer are performed by sputtering.

18. The method of claim 11, wherein the niobium layer is doped with at least one of titanium, tantalum, or vanadium.

19. A method of forming a niobium-tin superconducting radio frequency device having a plurality of cavities disposed in a series, the method comprising the steps of:

forming a unified bulk structure by, 3D printing a sand mold of the device, and melt casting copper in the mold to form the unified bulk structure, forming a niobium layer on an interior of the unified bulk structure, and heat treating the unified bulk structure and niobium layer to form a superconducting niobium-tin layer on the interior of the unified bulk structure.

20. The method of claim 19, wherein the unified bulk structure is formed completely of copper.

* * * * *